United States Patent [19]

Paller

[11] 3,942,660

[45] Mar. 9, 1976

[54] GLASS BOTTLE MOUTH INSERT

[76] Inventor: Gerald J. Paller, 214 N.E. 22nd St., Delray Beach, Fla. 33444

[22] Filed: Mar. 12, 1975

[21] Appl. No.: 557,873

[52] U.S. Cl. ..... 215/31

[51] Int. Cl.[2] ..... B65D 1/02

[58] Field of Search..... 215/31, 100 R; 222/566, 222/571

[56] References Cited

UNITED STATES PATENTS

| | | | |
|---|---|---|---|
| 186,750 | 1/1877 | Newton | 215/100 R |
| 1,695,851 | 12/1928 | Kersten | 215/100 R |
| 1,941,632 | 1/1934 | Staniland | 215/31 |
| 2,177,754 | 10/1939 | Tainsh | 222/566 |
| 2,736,447 | 2/1956 | De Brock | 222/571 |
| 2,789,740 | 4/1957 | Pellett | 222/571 |
| 2,848,145 | 8/1958 | Livingstone | 215/100 R UX |
| 3,179,290 | 4/1965 | Whitney | 222/571 |
| 3,491,925 | 1/1970 | Sundgren | 222/571 |

*Primary Examiner*—Donald F. Norton
*Attorney, Agent, or Firm*—Clarence A. O'Brien; Harvey B. Jacobson

[57] ABSTRACT

An insert for reclaiming glass bottles, and the like, chipped around the mouth thereof has a ring adhereable adjacent the mouth of the bottle to a wall of the throat provided in a neck of the bottle. Extending from the ring is a flange adhereable to a lip which terminates the neck of the bottle and configured to conform to the contour of the lip for covering the lip and adjacent portion of the throat and resurfacing the chipped area of the mouth of the bottle.

4 Claims, 6 Drawing Figures

FIG. 1
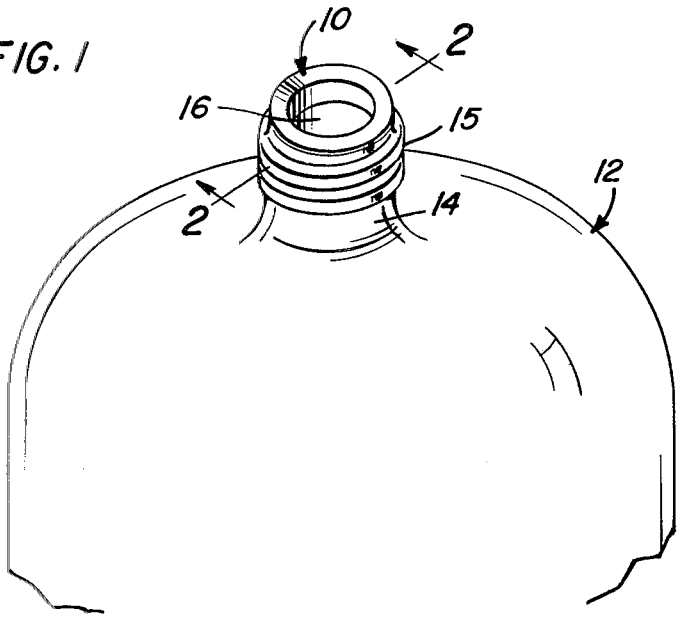
FIG. 3
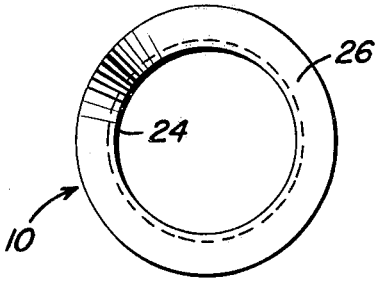
FIG. 4
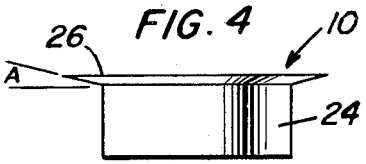
FIG. 5
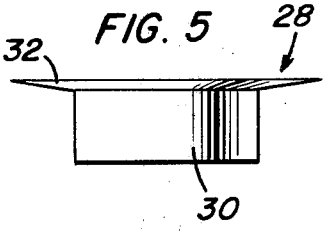
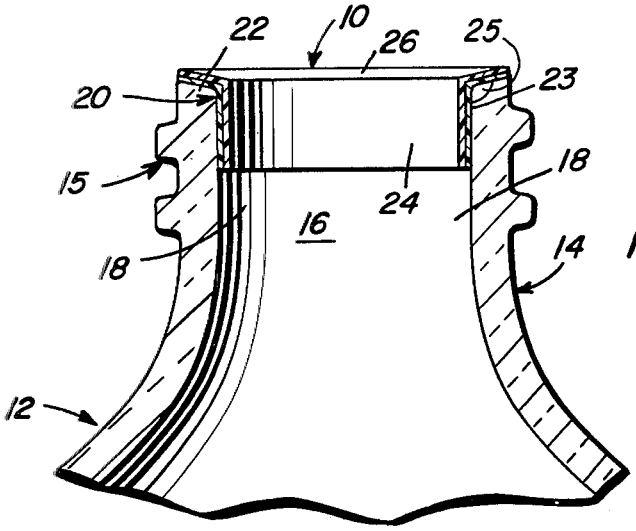
FIG. 2
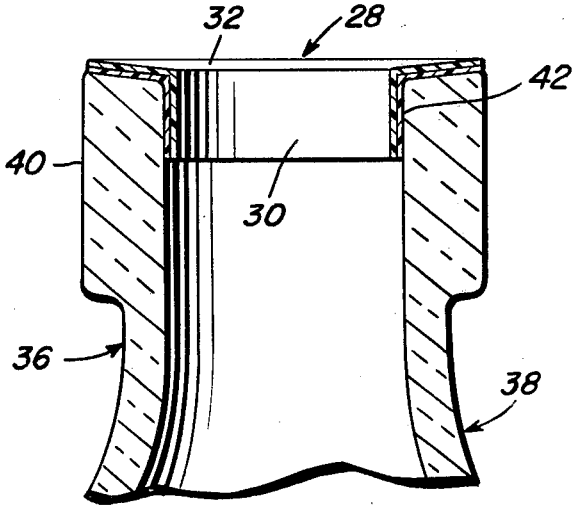
FIG. 6

GLASS BOTTLE MOUTH INSERT

BACKGROUND OF THE INVENTION

1. Field of the Invention

This invention relates generally to an insert for reclaiming glass bottles, and the like, that have been chipped around the top or mouth thereof, and particularly to an insert that permits the resurfacing of the sealing edge of a glass bottle to a new smooth and leakproof finish.

2. Description of the Prior Art

A problem that commonly occurs in conjunction with the use of the conventional five gallon jar bottles commonly used in homes and offices to contain drinking water is that the edges about the neck of the bottle frequently become broken or chipped to the extent that the conventional screw tops cannot be screwed onto the neck of the bottle.

The aforementioned problems with chipping and breaking about the neck of a bottle are also found with the conventional soft drink bottles, beer bottles, and the like.

Prior U.S. patents believed pertinent to the present invention are as follows:

| | |
|---|---|
| 596,485 | Jan. 4, 1898 |
| 1,720,888 | July 16, 1929 |
| 1,941,632 | Jan. 2, 1934 |
| 2,854,163 | Sept. 30, 1958 |
| 3,247,992 | Apr. 26, 1966 |

SUMMARY OF THE INVENTION

It is an object of the present invention to provide an insert which permits reclaiming of glass bottles and the like.

It is another object of the invention to provide an improved mouth construction for glass bottles and the like.

These and other objects are achieved according to the present invention by providing an insert having: a ring arranged for being adhered in a throat of a bottle adjacent the mouth of the bottle; and a flange extending away from the ring and arranged for being adhered to a lip which terminates a neck of the bottle and configured to conform to the contour of the lip for covering the lip. Advantageously, the ring is a hollow cylinder having a pair of spaced, open ends, with the flange being a continuous annular projection extending from one of the ends of the ring.

The ring and flange which form an insert according to the present invention are preferably constructed as a unit from a tough synthetic material capable of withstanding heat and caustic cleaning solutions encountered during cleaning of the associated bottle.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view showing a bottle provided with an insert according to the present invention.

FIG. 2 is a fragmentary, sectional view taken generally along the line 2—2 of FIG. 1.

FIG. 3 is a top plan view of the insert according to FIGS. 1 and 2.

FIG. 4 is an elevational view showing an insert according to FIG. 3.

FIG. 5 is an elevational view similar to FIG. 4, but showing a modified form of an insert according to the present invention.

FIG. 6 is a fragmentary, sectional view, similar to FIG. 2, but showing the insert of FIG. 5 arranged in the mouth of a bottle provided with a cork finish for receiving a snap-on plastic cap.

DESCRIPTION OF THE PREFERRED EMBODIMENTS

Referring now more particularly to FIGS. 1 and 2 of the drawings, an insert 10 according to the present invention is associated with a bottle 12 which may be, for example, chipped or broken around the mouth thereof. As illustrated, bottle 12 has a neck 14 provided with conventional screw threads 15 and having a wall 16 defining a throat 18. Further, neck 14 terminates in a mouth 20 including a lip 22 which merges inwardly with the wall of throat 18. As can be seen in FIG. 2, insert 10 is retained within mouth 20 of bottle 12 as by a suitable adhesive 23 to resurface and cover the chipped portion 25 in the lip 22.

Referring now more particularly to FIGS. 3 and 4 of the drawings, insert 10 can be seen to include a ring 24 arranged for being adhered in throat 18 adjacent mouth 20, and a flange 26 extending away from ring 24 and arranged for being adhered to lip 22 while covering the latter. For this purpose, flange 26 is configured to conform to the contour of lip 22. While the configuration of ring 24 will vary depending on the design of the bottle with which the insert is associated, it will be appreciated that in most instances ring 24 will have the illustrated configuration of a hollow cylinder provided with a pair of spaced, open ends. Further, flange 26 will usually be the illustrated continuous annular projection extending from one of the ends of ring 24, advantageously at the illustrated acute angle A with respect to the vertical wall of ring 24.

Ring 24 and flange 26 are preferably constructed as a unit—that is, in one piece as by molding, and the like, in a known manner—from a tough synthetic material, such as polypropylene, capable of withstanding heat and caustic cleaning solutions commonly encountered during cleaning of the associated bottle 12. The adhesive 23 must also have properties which enable it to withstand the heat and caustic cleaning solution encountered during cleaning, and since dissimilar materials are being bonded, in most instances, should remain flexible after setting or curing. Flexibilized epoxy and silicone rubber are examples of synthetic adhesives generally suitable for use as adhesive 23.

FIGS. 5 and 6 of the drawings show a modified insert 28 according to the present invention which, like insert 10, has a ring 30 and a projecting flange 32. Flange 32, however, is of slightly different configuration than flange 26 so as to conform to the configuration of a lip 34 terminating the neck 36 of a bottle 38 provided with a cork finish surface 40 for receiving a conventional snap-on plastic cap (not shown) and the like. Insert 28 may be constructed from the same material and in the identical manner as insert 10, and may be adhered to lip 34 and neck 36 as by an adhesive 42 identical to adhesive 23.

It is to be understood that while two possible designs for an insert according to the present invention have been shown in the drawing, other possible designs may be employed as necessary. The determining factor is the shape of the lip of the bottle; the flange of the insert must be configured to conform to the lip of the bottle. Further, an insert according to the invention may be made in any size depending on the size of the bottle to be provided with the insert.

While the invention is primarily intended for use with glass bottles, such as the conventional five gallon water bottle, the invention may also be employed with plastic bottles, and the like, as desired. In addition, although the invention has been disclosed as primarily intended for use in reclaiming existing bottles, it is to be understood that the invention could be employed with newly manufactured bottles. There would be less of a change of chipping the new bottles in their production as well as their delivery and, therefore, less possibility of chips of glass, and the like, getting into the customer's water cooler, dispenser, water pitcher, and the like.

While the illustrated embodiments terminate the insert at the outer edge of the lip of the bottle, it will be appreciated that the insert can continue down over the outside of the neck of the bottle so as to, in particular, restore broken screw threads, such as threads 15, commonly provided on screw finish bottles. In this manner, by using slightly oversized caps (not shown), a bottle which otherwise would have to be discarded can be reclaimed and continued in use.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a bottle having a neck provided with a wall defining a throat, the neck terminating in a mouth including a lip which merges inwardly with the wall of the throat, said lip being chipped such that the bottle is rendered unsafe for use, an insert for resurfacing the mouth of the bottle, the insert comprising, in combination with the bottle:

a. a ring adhered in the throat of the bottle adjacent the mouth of the bottle;

b. a flange extending away from the ring adhered to the chipped lip which terminates the neck of the bottle and configured to conform to the basic contour of the lip for covering the lip and resurfacing the mouth of the bottle; and c. adhesive means for adhering the ring and flange to the neck of the bottle.

2. A structure as defined in claim 1, wherein the ring is a hollow cylinder having a pair of spaced, open ends, with the flange being a continuous annular projection extending from one of the ends of the ring.

3. A structure as defined in claim 2, wherein the ring and flange are constructed as a unit from a tough synthetic material capable of withstanding heat and caustic cleaning solution encountered during cleaning of the bottle.

4. A structure as defined in claim 1, wherein the adhesive means is a flexibilized epoxy.

* * * * *